US010500628B2

(12) United States Patent
Honegger et al.

(10) Patent No.: US 10,500,628 B2
(45) Date of Patent: Dec. 10, 2019

(54) METHOD AND APPARATUS FOR REDUCING CUTTING IMPACT IN A PRECISION BLANKING PRESS

(71) Applicant: Feintool International Holding AG, Lyss (CH)

(72) Inventors: Hans-Ruedi Honegger, Wolfhausen (CH); Andreas Walther, Laupen (CH); Alex Wehrli, Kehrsatz (CH)

(73) Assignee: Feintool International Holding AG, Lyss (CH)

( * ) Notice: Subject to any disclaimer, the term of this patent is extended or adjusted under 35 U.S.C. 154(b) by 628 days.

(21) Appl. No.: 15/203,404

(22) Filed: Jul. 6, 2016

(65) Prior Publication Data

US 2017/0129000 A1 May 11, 2017

(30) Foreign Application Priority Data

Jul. 6, 2015 (EP) ..... 15002037

(51) Int. Cl.

| | |
|---|---|
| ***B21D 28/20*** | (2006.01) |
| ***B21D 24/14*** | (2006.01) |
| ***B30B 15/00*** | (2006.01) |
| ***B30B 15/22*** | (2006.01) |
| *B21D 28/16* | (2006.01) |

(52) U.S. Cl.
CPC ..... *B21D 28/20* (2013.01)

(58) Field of Classification Search
CPC .... B21D 28/20; B21D 28/16; B30B 15/0076; B30B 15/16; B30B 15/163; B30B 15/22; B30B 15/20
USPC ..... 72/336, 337
See application file for complete search history.

(56) References Cited

U.S. PATENT DOCUMENTS

| | | | | |
|---|---|---|---|---|
| 4,116,122 A * | 9/1978 | Linder | B21D 28/002 100/269.14 |
| 5,460,084 A * | 10/1995 | Otremba | B30B 1/323 100/269.05 |
| 2002/0117051 A1 | 8/2002 | Yoh et al. | |
| 2007/0101841 A1 | 5/2007 | Fahrenbach | |
| 2009/0071218 A1 | 3/2009 | Kohno et al. | |

(Continued)

FOREIGN PATENT DOCUMENTS

| | | |
|---|---|---|
| CN | 1372083 A | 10/2002 |
| CN | 101175585 A | 5/2008 |
| CN | 102168695 A | 8/2011 |

(Continued)

OTHER PUBLICATIONS

DE2824176 translation (Year: 1979).*

*Primary Examiner* — Elaine Gort
*Assistant Examiner* — Christopher B Wehrly
(74) *Attorney, Agent, or Firm* — Norris McLaughlin, P.A.

(57) ABSTRACT

In a method and an apparatus for reducing the cutting impact in a hydraulically-driven precision blanking press, the force necessary to reduce the cutting impact as a counterforce is generated directly in the pressure chamber of the drive piston such that the counterforce acts directly on the cutting punch and so that the design of the press can be simplified, costs can be reduced, no additional external hydraulic-mechanical means for reducing the cutting impact are needed, and so that the loads on the press and the die can be reduced.

3 Claims, 7 Drawing Sheets

(56) References Cited

U.S. PATENT DOCUMENTS

| | | | | |
|---|---|---|---|---|
| 2010/0132349 | A1* | 6/2010 | Brahmer | B30B 15/16 60/327 |
| 2015/0185726 | A1 | 7/2015 | Kohno | |

FOREIGN PATENT DOCUMENTS

| | | | | |
|---|---|---|---|---|
| CN | 104741431 | A | 7/2015 | |
| DE | 2350378 | A1 | 4/1975 | |
| DE | 2512822 | A1 | 9/1976 | |
| DE | 2824176 | A1 * | 12/1979 | B21D 28/20 |
| DE | 2824176 | C2 | 4/1988 | |
| DE | 4308344 | A1 | 9/1994 | |
| DE | 10339004 | B4 | 9/2006 | |
| DE | 102005053350 | A1 | 5/2007 | |
| DE | 102006039463 | A1 | 2/2008 | |
| DE | 10252625 | B4 | 9/2008 | |
| DE | 102007027603 | A1 | 12/2008 | |
| JP | 58110200 | A | 6/1983 | |
| JP | 60-162599 | A | 8/1985 | |
| JP | 60-244500 | A | 12/1985 | |

* cited by examiner

PRIOR ART

METHOD AND APPARATUS FOR REDUCING CUTTING IMPACT IN A PRECISION BLANKING PRESS

BACKGROUND OF THE INVENTION

The invention relates to a method for reducing the cutting impact in a precision blanking press equipped with a hydraulic main drive, a main piston in the press making a stroke movement between UT and OT during rapid traverse mode and performing the cutting or shaping operation in the power stroke, the main piston being guided in a main cylinder chamber of the base and supporting a table top, wherein the pressure chambers of the main piston are acted upon by the working pressure of a hydraulic fluid of a hydraulic system, the pressure being predetermined by a central control system and generated by a hydraulic pump unit.

The invention further relates to an apparatus for carrying out the method, comprising a main cylinder chamber disposed in the base of a hydraulically-driven precision blanking press, the main piston/ram being guided in the chamber and which can be acted upon by hydraulic fluid by way of pressure chambers, making a lifting motion in rapid traverse mode between UT and OT in the direction of the stroke axis and supporting a table top, and a hydraulic system for supplying the pressure chambers with the hydraulic fluid, which is adjustable to a predetermined working pressure by way of a central control system, the hydraulic system comprising at least one hydraulic pump unit.

Cutting impact on presses and the causes thereof have been known for a long time. The cutting process is known to consist of a clamping step in which the sheet material to be cut is clamped between a die block and a hold down device (guide plate), whereupon the cutting punch is placed onto the sheet material, a pretensioning step in which the cutting system, consisting of the sheet material, the blanking die and the press, is pretensioned elastically until the flow boundary is reached, a plastic deformation step in which the sheet material is cold-hardened to a maximum value as the cutting force increases, and upon reaching the limit of deformability the sheet material breaks through with the formation of cracks, a separation step in which the cut part is separated from the sheet material, the cutting force decreasing suddenly and the potential energy stored in the system being released, allowing the die and the press to suddenly release in the form of cutting impact, and release of elastic stresses, which cause the material near the cut surface to spring back and cause the punch and the die block to wear out.

There are a number of solutions to this which deal with the damping of the cutting impact on presses. DE 22 48 024C, DE 23 50 378 C2, DE 26 21 726C, DE 26 53 714 C, DE 102 52 625 B4, DE 103 39 004 B4, DE 10 2005 053 350 A1 and DE 10 2009 39 004 B4 disclose cylinder-piston units, with or without sensors, which act separately from the ram and which are used to damp the reverse deformation of the press frame. Other known solutions (DE 25 12 822 C, DE 10 2009 39 004 B4) try to absorb the cutting impact using an elastic press frame length.

The prior art according to DE 28 24 176 C2 discloses a hydraulic press having a large stroke for impact-free cutting or stamping, with a path-dependent servo-hydraulic control system for the ram movement, wherein a working piston for the press ram and at least one counterforce piston can be simultaneously acted upon with pressure fluid, wherein a set point transmitter controls the piston movements by way of a servo-valve for specifying a ram movement profile, the transmitter being an element of a control circuit, and wherein the working cylinder chamber for driving the press ram and the counterforce cylinder are spatially separated from one another.

DE 43 08 344 A1 discloses a method for controlling the drive of a hydraulic press for forming and/or cutting sheets or the like, the press comprising a piston-cylinder unit that can be acted upon on two sides for driving a press ram, wherein the drive piston is acted upon by a hydraulic medium in the manner of path displacement. What is provided is a hydraulic storage unit having the maximum working pressure, the unit supplying the piston of the piston-cylinder unit with hydraulic medium of the same pressure on both sides.

DE 10 2007 027 603 A1 describes a hydraulic drive, in particular for a press, a stamping or nibbling machine, and a method for controlling a hydraulic drive. The known drive has a dual-acting working cylinder with a piston which comprises a first working surface acting in the inward direction and a second working surface acting in the outward direction, each of the surfaces confining a pressure chamber, wherein at least two different pressures can be enacted by way of an actuator so as to retract and extend the piston into and out of the working cylinder toward at least one of the working surfaces. The hydraulic drive has an adjusting unit which enables a throttled reflux of hydraulic medium out of the first pressure chamber confined by the first working surface, wherein the drive comprises a control means for controlling the adjusting unit in such a manner, during or prior to a sudden acceleration of the piston due to the sudden release of force thereof, as to effect a hydraulic damping of the movement of the piston by way of a direct or indirect throttling of the reflux of hydraulic medium out of the first pressure chamber.

DE 10 2006 039 463 A1 further proposes to reduce the cutting impact by providing, within a closed hydraulic system, two different opposing forces acting on the ram during a cutting step, wherein the forces are switched depending on the path of the ram.

All of these known solutions have the common disadvantage of needing to use additional hydraulic-mechanically acting means to counteract the cutting impact; these additional means significantly increase the complexity of the press while at the same time complicating the design and increasing costs. In particular, additional adjusting and throttling units placed between the pressure chambers of the drive piston, or separate closed hydraulic systems, increase the reaction time and thereby the sluggishness of the overall system. Therefore, these solutions have not come to fruition. Moreover, throttling units have the disadvantage that they heat up, causing irreversible energy losses.

SUMMARY OF THE INVENTION

In light of this prior art, the object of the invention is to provide a method and an apparatus for precision blanking presses of the type mentioned above which can produce the force required to reduce the cutting impact, as a counterforce directly in the pressure chamber of the drive piston, such that the counterforce acts directly on the cutting punch and so that the design of the press can be simplified, costs can be reduced, no additional external hydraulic-mechanical means for reducing the cutting impact are needed, and so that the loads on the press and the die can be reduced.

This object is achieved using a method of the type mentioned above having the features of claim 1 and an apparatus with the features of claim 5.

Advantageous embodiments of the apparatus and method according to the invention can be found in the dependent claims.

The solution according to the invention is based on the underlying idea of regulating the working pressure in the first (upper) pressure chamber based on the working pressure in the second (lower) pressure chamber of the main piston by way of a pressure-limiting function.

This is accomplished through the following steps:

a) detecting the position of the main piston during its lifting motion toward a fixed stop long before the OT is reached, using a path measuring unit which detects the positional data of the main piston, and forwarding this position to the central control unit for processing;

b) continuously detecting the working pressures in the pressure chambers of the main piston, using pressure sensors which detect the pressures, and sending the same to the central control system;

c) determining the increase in working pressure and the maximum pressure thereof in the second pressure chamber, d) establishing a maximum force in the second pressure chamber from the product of the detected working pressure and a working surface of the main piston; and e) adjusting the pressure in the first pressure chamber by limiting the pressure of a tank valve associated with the first pressure chamber based on the determined force maximum according to step d), said adjustment being such that the working pressure in the first pressure chamber is increased accordingly to generate a force which counteracts the cutting impact as soon as the force maximum is exceeded and such that the counteracting force is held until the cutting step is finished.

It is of considerable importance that the counteracting force is very sensitive and precisely matchable to the magnitude of the cutting impact by way of the pressure regulation in the first pressure chamber in response to the working pressure in the second pressure chamber.

In another preferred embodiment of the method according to the invention, during a power stroke, the working pressure in the second pressure chamber of the main piston is made to be adjustable using the central control system by way of a controllable proportional valve, at least one pressure sensor for pressure detection, at least one pressure limiting valve for limiting the pressure of the flow stream and a proportional valve for the flow volume of the hydraulic pump unit.

According to another preferred embodiment of the method according to the invention, the OT position of the main piston is controlled using the central control system in such a way that the flow volume of the hydraulic pump unit is readjusted before the OT is reached.

Another particularly advantageous feature is that sensors which can be used as a path measurement unit for detecting the position of the main piston include sensors that operate contact-free and wear-free and are insensitive to moisture, oils and other contaminants.

The object is further achieved using an apparatus of the type mentioned above by providing the main piston with working surfaces which protrude in the shape of a discus edge and which subdivide the first and second pressure chambers into annuli in the main cylinder chamber lying one above the other with minimal travel, each of which comprises a pressure sensor for detecting the pressure in the respective pressure chamber, the sensors being connected separately to the central control system, to a proportional valve by way of a pressure-controlled 4/3-way proportional valve for limiting the pressure of a tank valve, and to an amplifier, and that a path measurement unit for detecting the OT position of the main piston, the unit being connected to the central control system, is associated with the main piston.

In another useful embodiment of the invention, a vent channel for venting the hydraulic fluid displaced from the first pressure chamber, the channel being openable and closable using the tank valve, and first fluid channels connected, by way of one bypass channel each, to second fluid channels which lead to the second pressure chamber open into the first pressure chamber, a proportional valve for opening and closing the bypass channels being disposed in each second fluid channel, respectively, wherein at least one of the second fluid channels is connected to a feed channel and to a branching channel in order to feed hydraulic fluid of a predetermined pressure from the hydraulic system to the second pressure chamber.

Another advantageous embodiment of the apparatus according to the invention provides that the second pressure chamber of the main piston is connected to a collection tank through the tank valve during the power stroke in order to adjust the flow using the hydraulic pump unit and the first pressure chamber, the connection being made by way of a controlled built-in valve, at least one pressure sensor for pressure detection, and at least one pressure limiting valve for limiting the pressure of the flow stream.

Another useful feature is the fact that the main piston comprises working surfaces of identical or differing sizes, allowing both synchronous pistons as well as other pistons to be used depending on the individual case. The proportional valves are pressure-controlled built-in valves, which can be disposed in the power stroke channels and the bypass channel and which are easy to install.

According to another preferred embodiment of the invention, the hydraulic pump unit comprises at least the proportional valve for adjusting the flow, at least the pressure sensor for controlling the proportional valve and at least the pressure limiting valve for limiting the pressure of the flow stream.

Other advantages and details can be found in the following description, with reference to the attached drawings.

The invention is explained in closer detail by way of an exemplary embodiment.

DETAILED DESCRIPTION OF THE INVENTION

Figure 1:
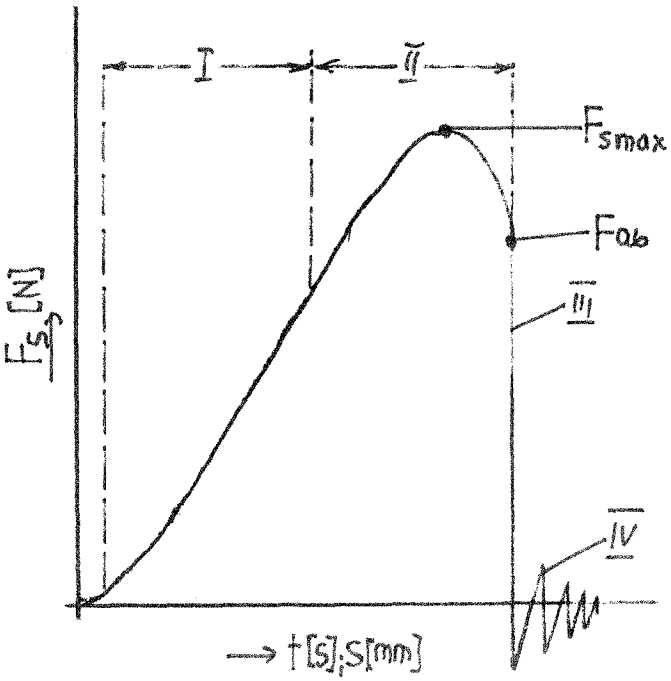
FIG. 1, a schematic representation of the cutting force profile in relation to the cutting process according to the prior art.

FIG. 1 shows the profile of the cutting force during shearing of a full-edged work piece according to the prior art (R.-A. Schmidt, "Umformen and Feinschneiden" (Forming and Precision Blanking), Carl Hanser-Verlag, 2007, pg.

144-157). As can be seen, the cutting process first passes through an area of elastic deformation of the material (Section I) and the press frame, in which the cutting force $F_S$ increases linearly without any plastic deformation of the material. As the punch penetrates further into the material, the material begins to flow plastically, wherein the cutting force $F_S$ continues to increase (Section III). In this area, two counteracting mechanisms affect the magnitude of the cutting force $F_S$, namely the increase in cutting resistance due to cold-hardening of the material as the cutting punch penetration depth into the material increases, and the decrease in the cutting force $F_S$ due to the decrease in cross section of the rest of the material transferring the force. Until the maximum cutting force $F_{Smax}$ is reached, the cold-hardening portion dominates, and thereafter the decrease in the remaining cross section dominates so that the cutting force $F_S$ decreases again.

The separation phase is characterized by the appearance of cracks in the material, which show that the capacity of the material to deform has been reached (Area III). The material breaks through and the cutting force $F_S$ drops abruptly, whereupon the cutting impact, in which the die and the press are suddenly released, takes place. The system (die, press) begins to oscillate in a manner similar to a released spring, the oscillatory characteristics depending on the resonant frequencies of the die and the press (Area IV). This is where the invention begins.

Figure 2:
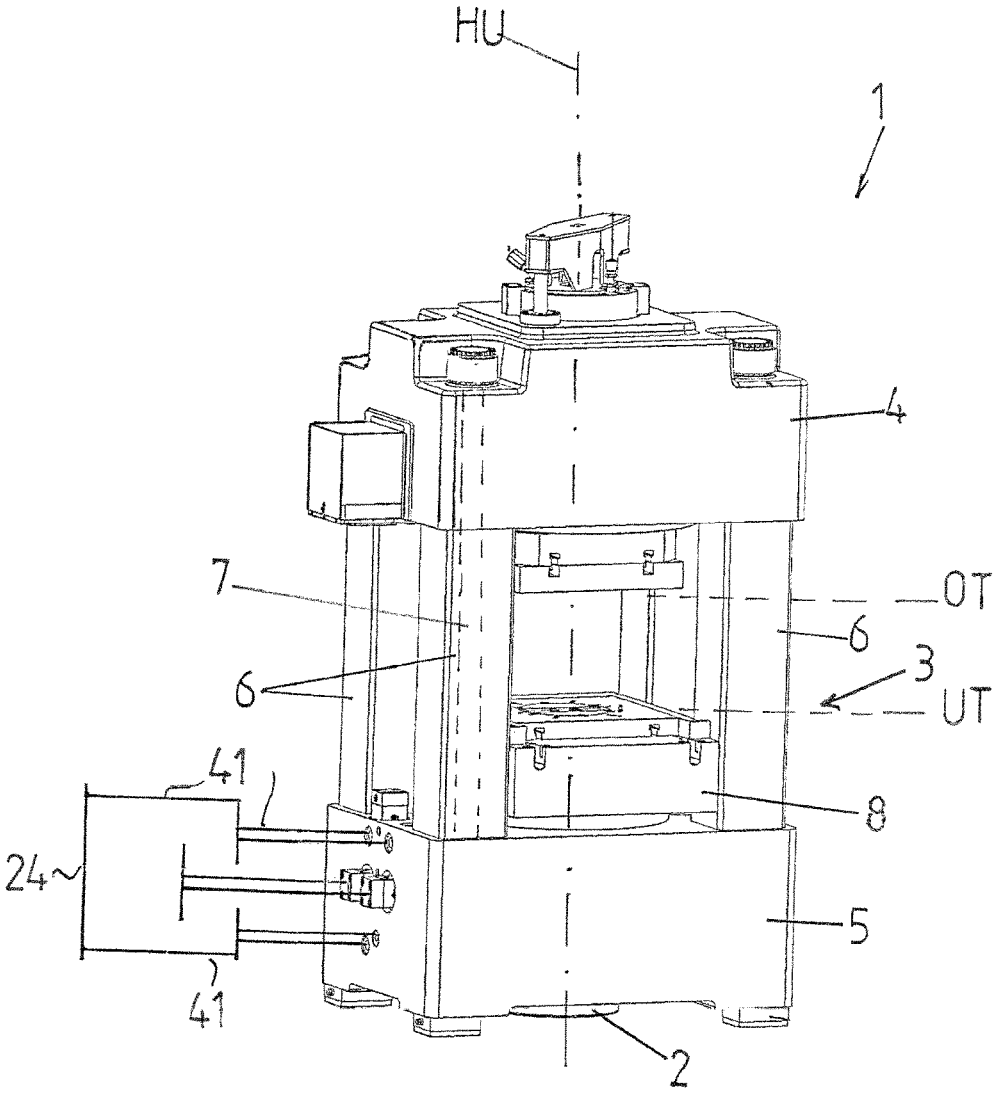
FIG. 2, a perspective view of a precision blanking press connected to the hydraulic system.

FIG. 2 shows a perspective representation of a hydraulically-driven precision blanking press 1, the main drive 2 of which basically facilitating a stroke movement between a lower dead point UT and an upper dead point OT in the direction of the stroke axis HU upward from below. The press frame 3 of the press 1 comprises a top 4, a base 5, box-shaped hollow columns 6 and tie rods 7. The main drive 2 is supplied with hydraulic fluid by way of hydraulic lines 41 from a hydraulic system 24.

Figure 3:
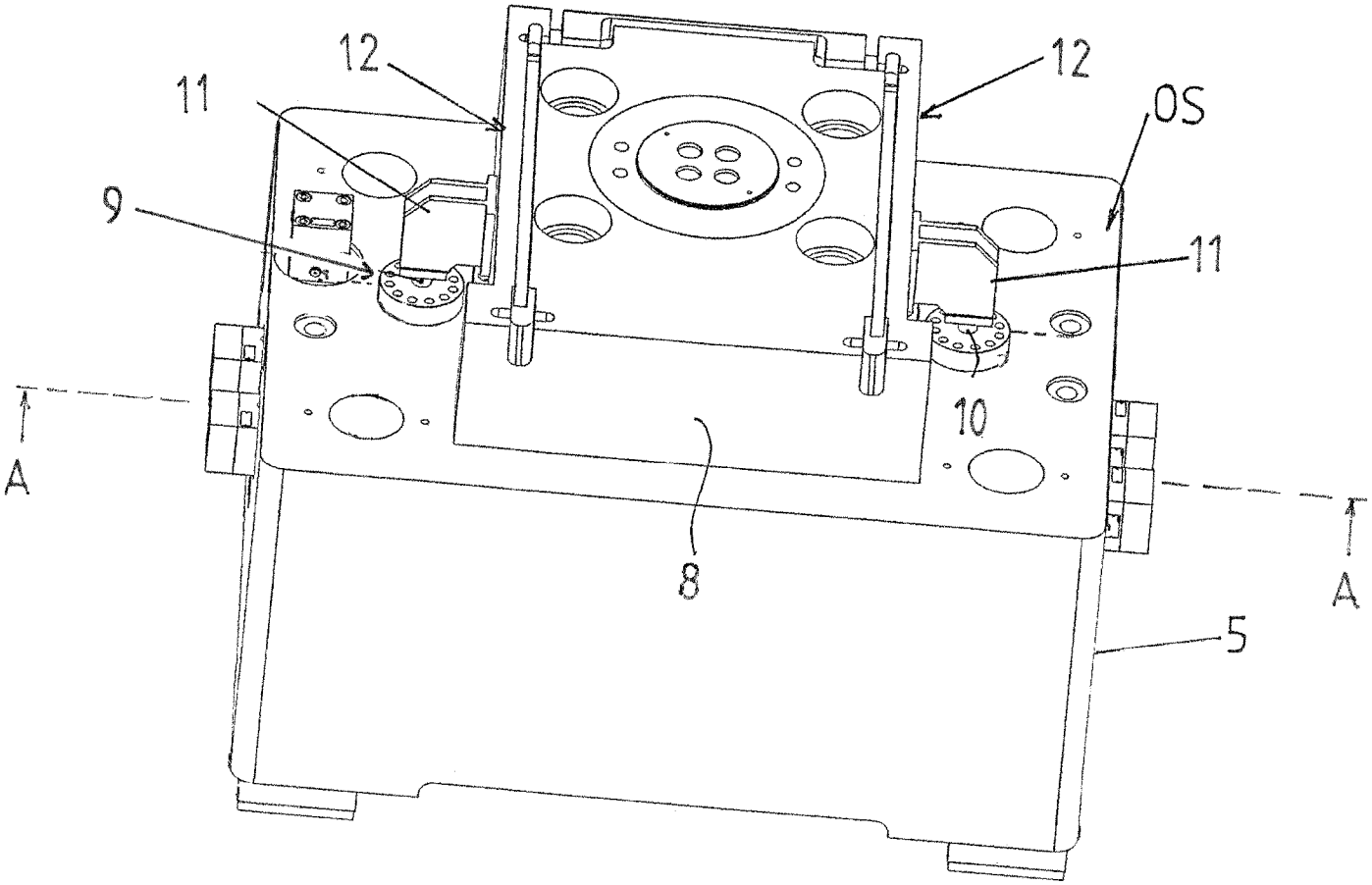
FIG. 3, a perspective view of the base with table top.

As illustrated in FIG. 3, a table top 8 is disposed at the top side OS of the base 5, the table top supporting the bottom part of the die, which is not shown. Two opposing fast-acting cylinders 9 are disposed in the base 5 approximately in the middle, the cylinders being aligned parallel to the stroke axis HU, each of the cylinders having a fast-acting piston with a piston rod 10 connected to a support 11 which is attached to a side wall 12 of the table top 8, so that the table top 8 with the bottom part of the die can be raised in the OT direction or lowered in the UT direction in rapid traverse mode.

Figure 4A:
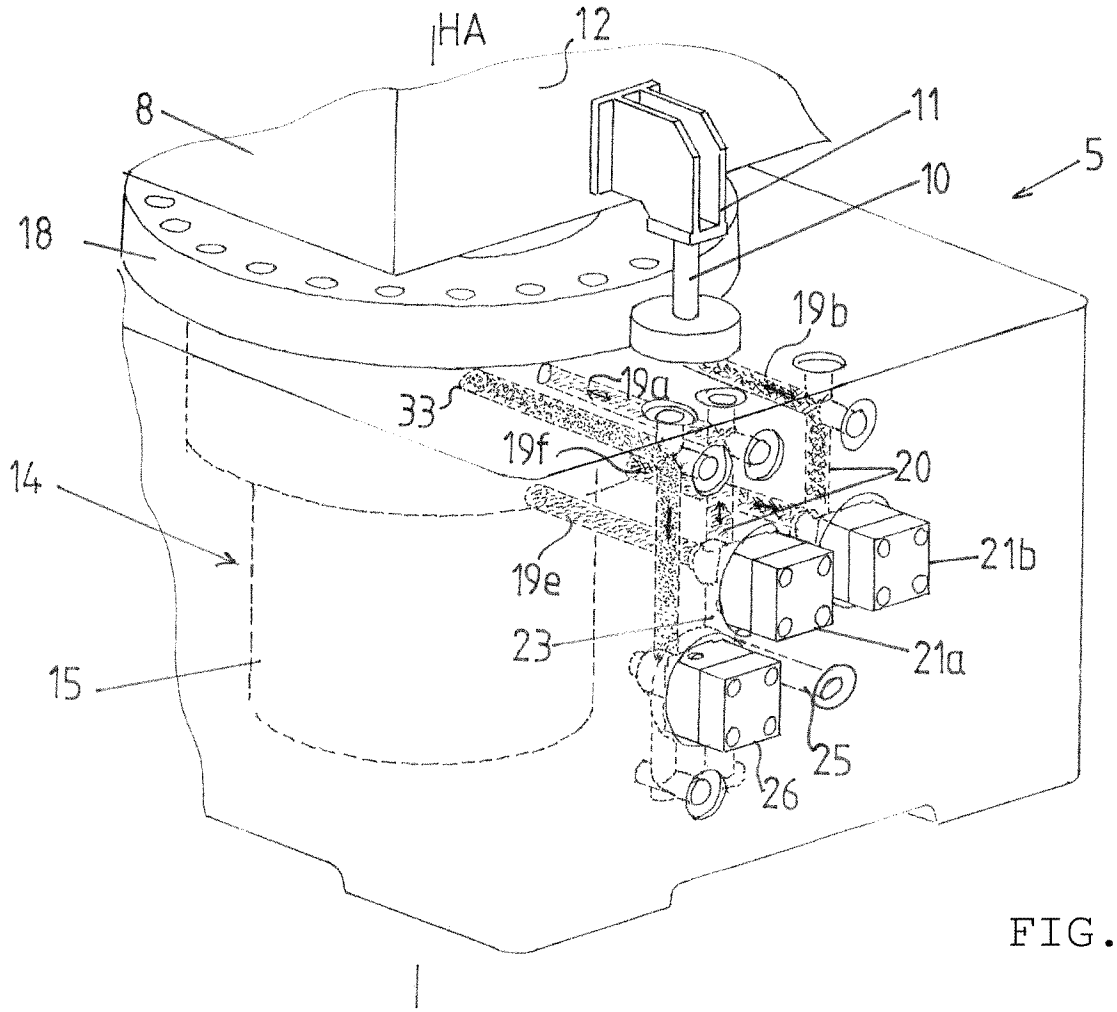
FIGS. 4*a* and 4*b*, perspective views of the base, showing the position of the fluid channels and the vent channel.
Figure 4B:
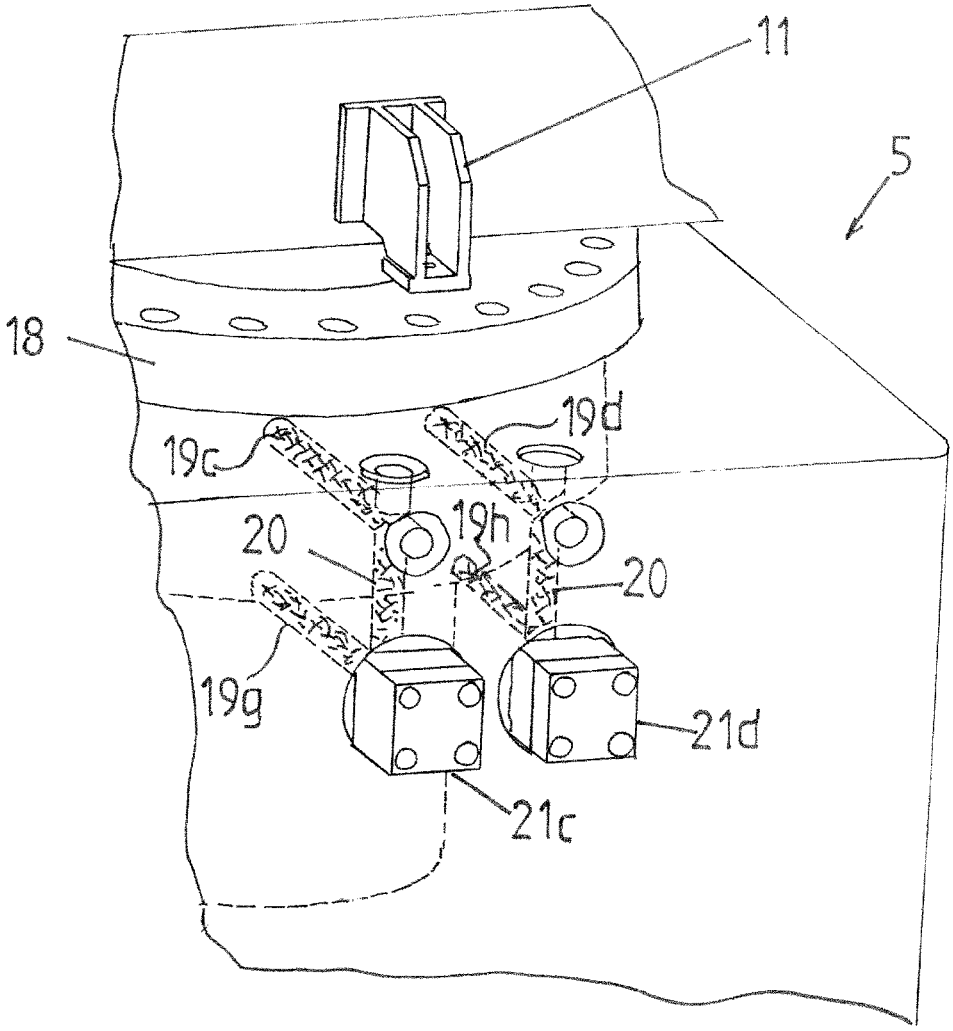
Figure 5:
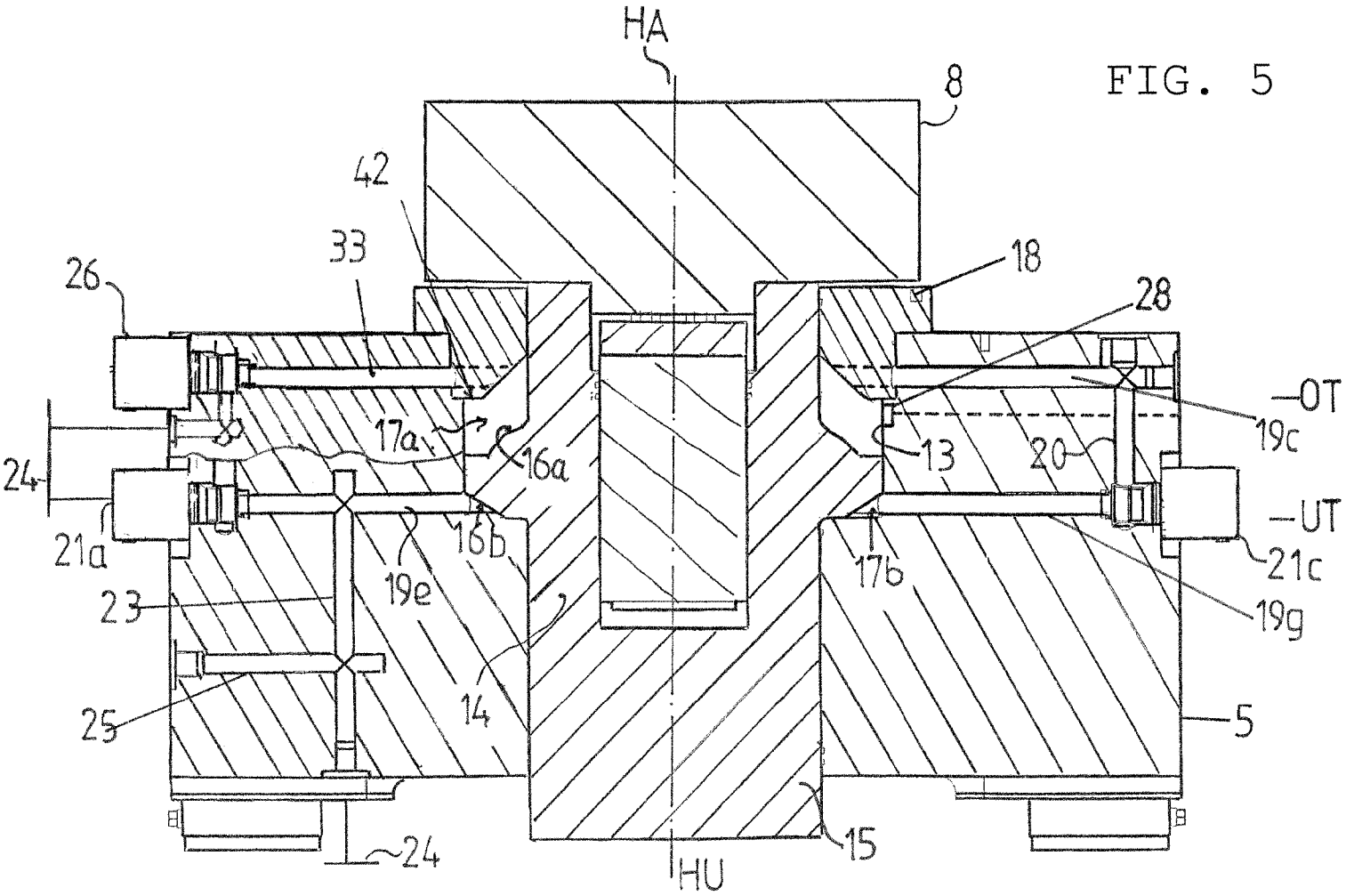
FIG. 5, a section of the base with table top according to line A-A in FIG. 3.

FIGS. 4*a*, 4*b* and 5 show the spatial position of the fluid channels 19*a* though 19*h* and of the vent channel 33 in the base 5 in a transparent representation and in a sectional view according to line A-A of FIG. 3.

A main cylinder chamber 13 is formed in the base 5, the axis HA of which lies on the stroke axis HU of the precision blanking press, and which holds the dual-acting main piston 14.

The main piston 14 comprises a cylindrical shaft 15 which has upper and lower working surfaces 16*a* and 16*b* which protrude perpendicular to axis HA in the form of a discus edge, the surfaces subdividing the main cylinder chamber 13 into a first (upper) pressure chamber 17*a* and a second (lower) pressure chamber 17*b* with a short stroke height such that the base 5 is compact and has a low design height.

The main cylinder chamber 13, and as a result the upper pressure chamber 17*a*, is sealed off pressure-tight by way of a cover 18 which is fastened to the base 5. The cover 18 is designed such that it also forms a fixed stop 42 for the working surface 16*a* at the upper dead point OT.

First (upper) fluid channels 19*a*, 19*b*, 19*c* and 19*d* and second (lower) fluid channels 19*e*, 19*f*, 19*g* and 19*h* lead to the pressure chambers 17*a* and 17*b* of the main piston 14, the channels being disposed one atop of the other in the base 5 perpendicular to the stroke axis HU corresponding to the elevation of the pressure chambers 17*a* and 17*b*. Fluid channels 19*a* through 19*d* are connected to fluid channels 19*e* through 19*h* by way of one bypass channel 20, respectively.

Moreover, a pressure-controlled proportional valve 21*a*, 21*b*, 21*c* and 21*d* is disposed in each of the second (lower) fluid channels 19*e* through 19*h* as a built-in valve, each of said valves closing the respective bypass channel 20 when the second pressure chamber 17*b* is acted upon by hydraulic fluid of a predetermined pressure. The lower fluid channel 19*e* is connected to a feed channel 23 that is disposed in the base 5 parallel to the stroke axis HU and a branch channel 25 which branches from the feed channel, the hydraulic system 24, which is not further illustrated, being connected to the branch channel.

In addition, a vent channel 33 opens into the first pressure chamber 17*a*, with a tank valve 26 for opening and closing the vent channel 33 being disposed therein as a built-in valve. The tank valve 26 is in the open position when the hydraulic fluid located in the first pressure chamber 17*a* is displaced during the power stroke.

When the pressure chamber 17*b* is acted upon by hydraulic fluid of a predetermined pressure via the branch channel 25 and the feed channel 23 with the first pressure chamber 17*a* vented via the vent channel 33 and the tank valve 26, the main piston 14 makes a corresponding stroke movement in the power stroke mode and initiates the cutting and forming process.

A path measuring unit 28, for example in the form of an eddy current sensor, is provided for the main piston 14. The path measuring unit 28 can be disposed along the first (upper) pressure chamber 17*a* in the base 5. However, it is also possible to position the path measuring unit 28 along the shaft 15 without straying from the spirit of the invention. It is only important that the positional data for the main piston 14 can be continuously detected during the stroke movement thereof in the OT direction.

The path measuring unit 28 transfers the positional data to the central control system 29 for further processing.

Figure 6:
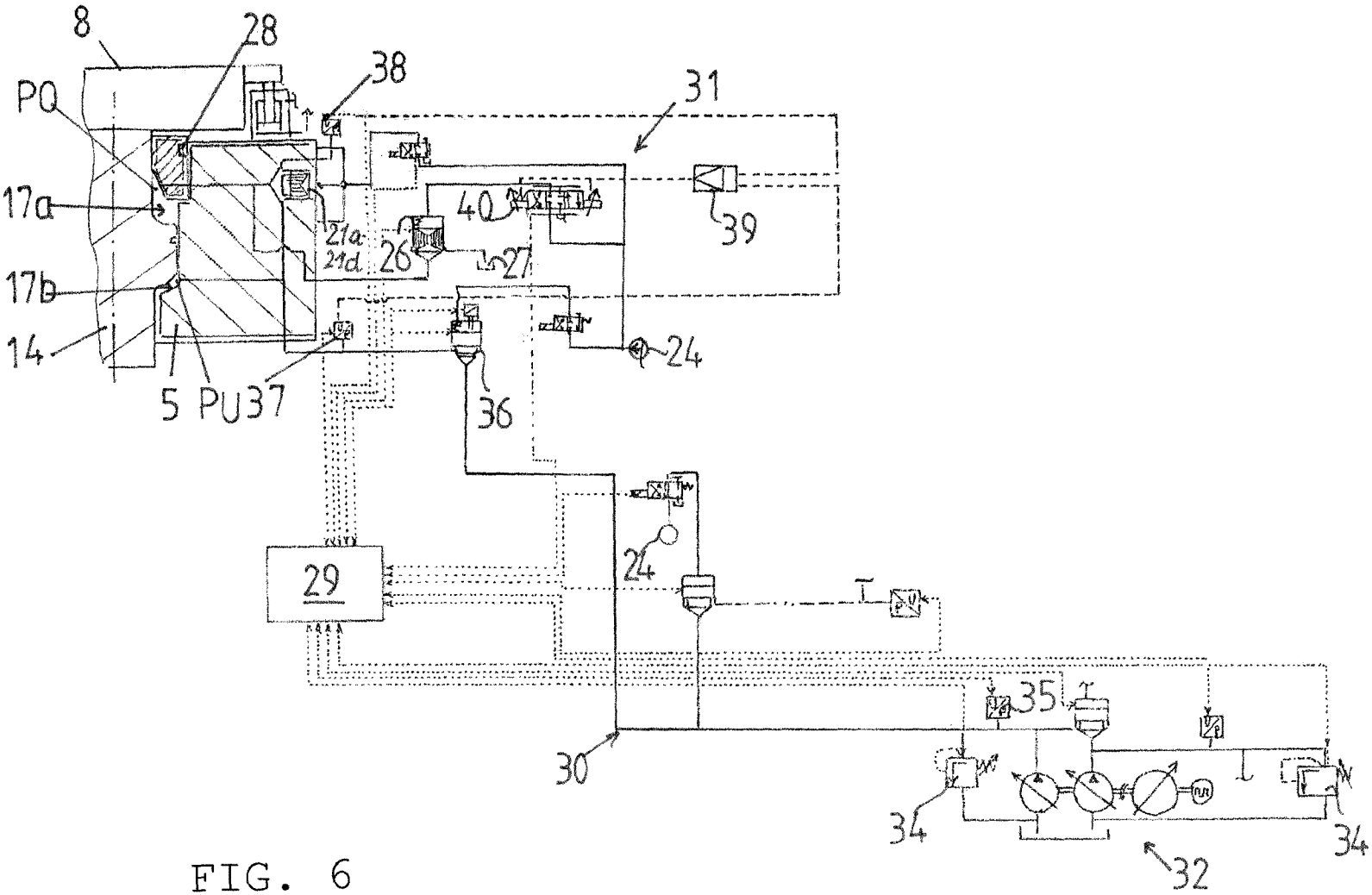
FIG. 6 a schematic representation of the operational sequence of the method according to the invention.

The operational sequence of the method according to the invention is described with the aid of FIG. 6, which shows the hydraulic line 30 for the power stroke of the main piston 14 and the hydraulic line 31 for controlling the cutting impact.

The hydraulic line 30 for the power stroke comprises a hydraulic pump unit 32 having at least one proportional valve for adjusting flow, at least one pressure regulating valve 34 for limiting the pressure of the flow stream and at least one pressure sensor 35 for pressure detection in order to limit the power output and forward the pressure value to the central control system 29 for purposes of operating the pressure limiting valve 34, a controlled built-in valve 36 for releasing the hydraulic fluid fed to the second (lower) pressure chamber 17*b* for purposes of the power stroke, a pressure sensor 37 for continuous detection of the working pressure $P_U$ in the second (lower) pressure chamber 17*b* and pressure chambers 17*a* and 17*b* of the main piston 14.

The proportional valves 21*a* through 21*d*, which are disposed in the fluid channels 19*e* through 19*h* and which open or close the vent channel 33, are part of hydraulic line 31, as is a pressure sensor 38 which is associated with the first (upper) pressure chamber 17*a* and is used for continuously detecting the working pressure $P_O$ in the first (upper) pressure chamber 17*a* and for forwarding the detected pressure values to the central control system 29 for processing, an operational amplifier 39 connected both to the pressure sensor 37 for the second (lower) pressure chamber 17*b* and to the pressure sensor 38 for the first (upper) pressure chamber 17*a*, as well as to a pressure-controlled 4/3-way proportional valve 40 which holds a tank valve 26 open during the power stroke or through pressure regulation.

The method according to the invention includes the following steps:

a) detecting the position of the main piston 14 during the stroke movement thereof toward a fixed stop 42 long before the OT is reached, using a path measuring unit 28 associated with the main piston 14, the unit detecting the positional data of the main piston 14 and forwarding this data to the central control system 29 for processing;

b) continuously detecting the working pressures $P_O$ and $P_U$ in the pressure chambers 17*a* and 17*b* of the main piston 14 by way of the pressure sensors 37 and 38, which detect the pressure values and send them to the central control system 29;

c) determining the increase in working pressure $P_U$ and the maximum pressure thereof in the second pressure chamber 17*b;* d) establishing a maximum force in the second pressure chamber 17*b* from the product of the detected working pressure $P_U$ and a working surface 16*b* of the main piston 14, and measuring the decrease in said force; and e) adjusting the pressure in the first pressure chamber 17*a* by limiting the pressure of a tank valve (26) associated with the first pressure chamber based on the force maximum determined and the decrease thereof according to step d), said adjustment being such that the working pressure $P_O$ in the first pressure chamber 17*a* is increased accordingly to generate a force which counteracts the cutting impact as soon as the force maximum is exceeded and such that the pressure is maintained until the cutting process is finished.

The invention claimed is:

1. A method for reducing cutting impact in a precision blanking press equipped with a hydraulic main drive, wherein a main piston, which is guided inside of a main cylinder chamber of a base and which supports a table top, makes a stroke movement in rapid traverse mode between a lower dead point UT and an upper dead point OT and, in a power stroke, executes a cutting or shaping operation, wherein first and second pressure chambers of the main piston are acted upon by a working pressure of a hydraulic fluid from a hydraulic system, working pressure being predetermined by a central control system and generated by a hydraulic pump unit, the method comprising the following steps:

a) detecting, with a path measuring unit, position of the main piston during the stroke movement thereof toward a fixed stop before the OT is reached, the path measuring unit being operatively associated with the main piston and being configured to acquire positional data of the main piston, and forward the data to a central control system for processing;

b) continuously detecting with pressure sensors, working pressures in the first and second pressure chambers of the main piston, the first and second pressure chambers and the main piston being so configured that the first and second pressure chambers apply opposing forces to respective first and second working surfaces of the main piston, the first pressure chamber applying force to the first working surface of the main piston, toward the UT, and the second pressure chamber applying force to the second working surface, toward the OT, the pressure sensors being configured to detect the pressure values and send said values to the central control system;

c) determining an increase in the working pressure and maximum pressure thereof in the second pressure chamber;

d) determining a maximum force in the second pressure chamber from a product of the detected working pressure in the second pressure chamber and area of the second working surface of the main piston and measuring a decrease of said force; and e) adjusting the working pressure in the first pressure chamber with a tank valve associated with the first pressure chamber based on the determined maximum force and the decrease thereof according to step d), said adjustment being such that the working pressure in the first pressure chamber is increased to generate a force which counteracts the cutting impact as soon as the force maximum is exceeded and such that the working pressure in the first pressure chamber is maintained until the cutting process is finished.

2. The method according to claim 1, wherein the working pressure in the second pressure chamber of the main piston during the power stroke is adjusted using the central control system by way of a controllable proportional valve, at least one of the pressure sensors for pressure detection, at least one pressure limiting valve for limiting pressure of hydraulic fluid supplied to the second pressure chamber and a proportional valve configured to adjust flow volume of the hydraulic pump unit.

3. The method according to claim 1, further comprising adjusting position of the main piston with the central control system as the OT is approached by controllably reducing flow volume of the hydraulic pump unit before the OT is reached.

* * * * *